United States Patent [19]

Miller

[11] 4,252,214

[45] Feb. 24, 1981

[54] SAFETY DESCENT DEVICE

[76] Inventor: James W. Miller, Rte. 1, Box 251, Overton, Tex. 75684

[21] Appl. No.: 94,336

[22] Filed: Nov. 14, 1979

[51] Int. Cl.[3] ..... A62B 35/00

[52] U.S. Cl. ..... 182/8

[58] Field of Search ..... 182/3, 4, 5, 6, 7, 8, 182/9, 10, 42, 43, 189, 190, 191, 192, 193

[56] References Cited

U.S. PATENT DOCUMENTS

| | | | |
|---|---|---|---|
| 481,252 | 8/1892 | Brainard | 182/6 |
| 495,437 | 4/1893 | Steegmann | 182/8 |
| 511,896 | 1/1894 | Killeen | 182/8 |
| 1,272,160 | 7/1918 | Weiss | 49/359 |
| 1,630,484 | 5/1927 | Fritts | 182/5 |
| 1,849,725 | 3/1932 | Quick | 182/10 |
| 1,927,469 | 9/1933 | Plumpton | 182/8 |
| 2,368,081 | 1/1945 | Marsh | 182/106 |
| 2,538,904 | 1/1951 | Herod | 182/8 |
| 2,616,609 | 11/1952 | Herod | 182/8 |
| 2,670,890 | 3/1954 | Hodge | 182/10 |
| 2,829,814 | 4/1958 | Warner | 182/17 |
| 2,946,396 | 7/1960 | McDougal | 182/3 |
| 3,130,815 | 4/1964 | Zahner | 182/112 |
| 3,137,487 | 6/1964 | Lesser | 182/3 |
| 3,220,511 | 11/1965 | Holkesvic | 188/65.4 |
| 3,260,328 | 7/1966 | McGowan | 182/5 |
| 3,826,335 | 7/1974 | Allen | 182/10 |
| 3,908,791 | 9/1975 | Kleine | 182/8 |

FOREIGN PATENT DOCUMENTS

| | | | |
|---|---|---|---|
| 163705 | 11/1933 | Switzerland | 182/8 |

OTHER PUBLICATIONS

Sala, Safety Block Fall, Machinery Center Inc. P.O. Box 964, Salt Lake City, Utah.

Dubl-Lock, Ladder Climber's Safety Device, Atlas Safety Equipment Co. Inc. 28–48 Roebling St. Brooklyn, N.Y.

Rohn-Loc, Safety Climbing Device, Rohn Manufacturing Division of UNARCO Ind. P.O. Box 2000, Peoria, Ill.

Ramco, Derrick Glide, Safety Elevator, Ramco Ind. 903 Hodgkins, Houston, Tex.

*Primary Examiner*—Reinaldo P. Machado

*Attorney, Agent, or Firm*—Richards, Harris & Medlock

[57] ABSTRACT

A fall prevention safety device for attachment to a harness worn by a workman for providing a safely controlled descension rate from an elevated structure includes a cable having one end connected to the harness and strung around a double pulley system having an upper pulley mounted to the elevated structure and a lower pulley mounted to the upper end of a vertically reciprocal plunger which falls substantially unimpeded into a hydraulic cylinder. The cylinder substantially resists upward withdrawal of the plunger. The other cable end is connected to the upper pulley yoke such that during ascent of the workman up the structure, the lower pulley and plunger move downwardly and take up cable slack. If the workman slips and falls at any point during ascent, the cable immediately and automatically provides descension at a controlled rate determined by the resisted withdrawal rate of the plunger as the cable now pulls the lower pulley upward. The hydraulic cylinder includes a bypass line with ports communicating with the hydraulic cylinder at upper and lower compartments above and below the inner plunger end having a seal therearound defining the two compartments. The inner plunger end also carries a one-way valve which is in an open condition during downward plunger movement and is closed by fluid pressure upon initiation of workman descent.

20 Claims, 3 Drawing Figures

SAFETY DESCENT DEVICE

BACKGROUND

Fall preventive safety equipment for climbers and elevated workers are well known in the art and typically employ a belt or harness worn by the user and connected to a cable for supporting the worker in case of an accidental slip from a ladder or fall from a platform or the like. In safety devices for ladder climbers, the harness may have a lock mechanism which slides along the cable during ascent but which locks thereto at the initiation of descent. In another arrangement, the apparatus being scaled may have a locking device anchored thereto through which the cable may slide during ascent of the climber and which locks the cable against reverse movement.

These types of prior safety devices have been useful in that they permit upward ascension of the climber without resistance and automatically adjust to the height attained during ascension, and prevent a fall of the climber therefrom without an intermediate slack period followed by a sudden jerk on the climber as the cable tautens.

While these prior safety devices have been useful for their intended purposes, they are subject to one or more disadvantages. The locking device statically locks the climber in position relative to the cable and must be mutually released to enable discension of the climber. If the locking device is on the harness of the climber and if the climber is within reach of the ladder, then this type of lock may not be objectionable. However, if the locking device is disposed along the cable upstream of and not reachable by the climber, or if the climber is not within reach of the ladder or is swinging therepast on a cable, then this type of locking device presents serious disadvantages.

A need has thus arisen for a safety device which automatically adjusts to the attained height of a climber or elevated worker and which eliminates the above disadvantages.

SUMMARY OF THE INVENTION

The present invention overcomes the above noted and other disadvantages by providing a safety device which permits free ascension of a climber without resistance, automatically adjusts to the incremental climbed height to prevent a fall therefrom, and dynamically, not statically, arrests the fall of the elevated worker or climber by providing a slow resistive descension rate, and hence alleviate the necessity of manual release of a static locking mechanism. A controlled descension rate is automatically and immediately provided from any and all points along the ascension path.

In a particularly desirable aspect of the invention, a simple, efficient and inexpensive structure maintains constant and automatic viligence for climber safety at all incrementally attained heights, not just the top of the ascension path. The invention provides the highly desirable advantage of being able to control descent of the climber immediately from any height without having to externally actuate a control mechanism to a descent mode or having to wait until a switch is tripped at the top of the ascension path. The safety device of the present invention is always in readiness to arrest climber descent at a controlled rate.

In preferred form, a long stroke single action fluid cylinder, containing a fluid such as hydraulic oil or air, is used in connection with a system of pulleys to permit free ascension of a climber while taking up cable slack, and to provide descension from any point in the climb at a controlled rate. Ascension of the climber permits, through intermediately disposed pulleys, downward gravitationally induced lowering of a plunger within the fluid cylinder without resistance by the contained fluid and without the use of an external plunger driving power source such as compressor or pump. Upon descension of the climber, the plunger is pulled upwardly by the cable through the intermediate pulley system. This upward movement of the plunger is resisted by fluid within the cylinder and controlled by an interconnecting valve system having ports communicating with the cylinder.

In another aspect of the invention, the plunger has associated therewith a one-way valve within the cylinder, and the cylinder has a pair of ports disposed adjacent opposite ends thereof above and below the one way valve and communicating externally of the cylinder.

In accordance with another aspect of the invention, a safety device of the aforementioned character is provided which is easily adaptable for use in a wide variety of existing elevated structures as a simple and inexpensive add-on, including both conventional and telescoping oil derricks.

In accordance with another aspect of the invention, an automatic safety check of cable strength is provided upon set-up of the elevated structure, to protect the workman against unknown faulty or worn cables, and against neglect of pre-testing thereof to recommended specifications.

Other aspects and advantages will become apparent hereinafter.

DETAILED DESCRIPTION

Figure 1:
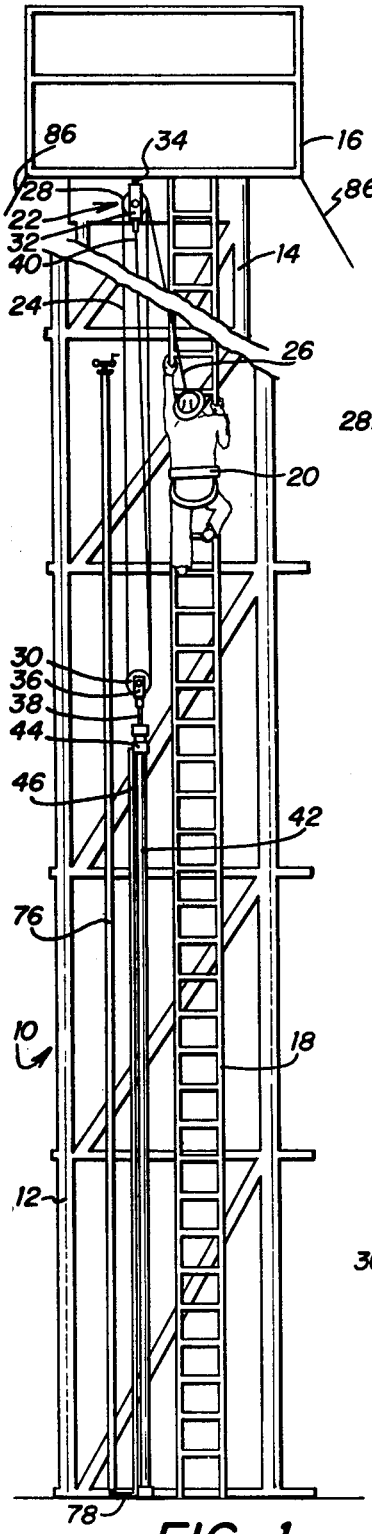
FIG. 1 is a front elevation view of an oil derrick employing a safety device constructed in accordance with the invention.

There is shown in FIG. 1 a telescoping oil derrick generally designated by reference character 10 having a lower section 12 and an upper section 14 topped by derrick crown 16. The derrick has a ladder 18 mounted thereto which a workman may climb to reach the top. The climbing workmen wears a harness or belt 20, such as the type made by Lewis Manufacturing Company, Oklahoma City, Oklahoma, type HCB, which is a two strap belt with one strap around the waist and the other under the seat of the climber.

Figure 2:
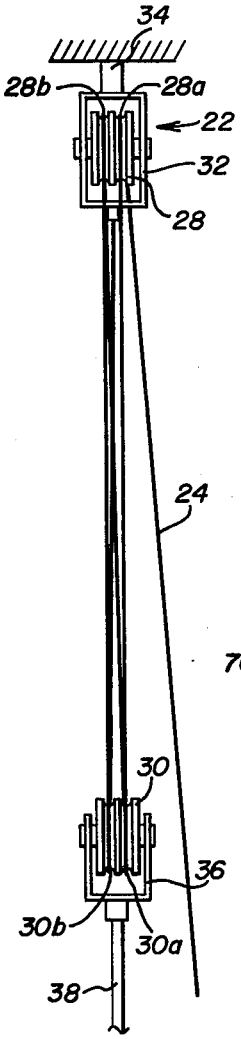
FIG. 2 is a partial side elevation view of the pulley system of FIG. 1.

A dual pulley system, generally designated 22, is provided in conjunction with a safety cable 24 having one end 26 attached to the front of safety belt 20. The cable is a 3/16ths inch galvanized aircraft cable rated at 1400 pounds breaking strength and is 315 feet long. The pulley system includes a pair of pulleys, upper pulley 28 and lower pulley 30, each of which is a 10 inch double sheave roller bearing pulley with semicircular guards to prevent the possibility of cables coming out of the sheaves. Upper pulley 28 is connected by yoke 32 to a 3 inch I-beam 34 welded to the derrick crown and projecting out above the ladder. Lower pulley 30 is connected by yoke 36 to the upper end of a 1¼ inch by 26 foot long polished plunger rod or actuator 38, to be more fully described hereinafter in conjunction with retraction means such as cylinder 42. The remaining cable end 40 is connected to the bottom of yoke 32. The cable thus extends from the safety belt of the climber over front sheave 28*a* of upper pulley 28, FIG. 2, then downwardly around front sheave 30*a* of the lower pulley, then upwardly around rear sheave 28*b* of the upper pulley, then downwardly around rear sheave 30*b* of the lower pulley, then upwardly to be connected at 40 to the bottom of yoke 32.

A 30 foot long 2⅞ inch hydraulic cylinder 42 is mounted vertically to the lower section of the derrick. This cylinder is closed at its bottom end and receives polished plunger rod 38 for reciprocal vertical movement therein. The open top end of the cylinder is sealed by a stuffing box 44 with packing which provides a liquid tight seal between plunger rod 38 and the inner upper side wall of the cylinder 42 while allowing reciprocation of plunger 38. A 30 foot long ½ inch fluid bypass line 46 is attached along the side of and tapped into each end of cylinder 42 at communication ports 48 and 50. Bypass line 46 has an adjustable control valve 52 for providing various degrees of orifice constriction in line 46 to control flow rates therethrough. Bypass line 46 also includes a choke 54 which sets a maximum flow rate therethrough.

Attached to the lower end of plunger rod 38 is a 2⅞ inch tubing swab 56 with two swab cups 58 and 60. The tubing swab is an elongated tubular member closed at the top and open at the bottom and having annular flanges 62 and 64 extending radially laterally therefrom substantially to the inner wall of cylinder 42 and supporting swab cups 58 and 60 to perform a gasket like function comparable to that of a piston ring to thus seal and isolate upper and lower compartments or chambers 59 and 61 within the cylinder as the plunger rod and tubing swab reciprocate vertically therein. The interior tubular wall of tubing swab 56 has near the upper end thereof above swab cups 58 and 60, an inwardly laterally extending annular flange 66 forming an interior central circular aperture 68. Disposed in the cavity 70 between inner flange 68 and the top interior wall of tubing swab 56 is a sphere or ball 72 having a diameter greater than that of circular aperture 68 and providing a ball check valve. Formed laterally through the upper side tubular walls of tubing swab 56 are one or more apertures 74 communicating with cavity 70 and the upper interior compartment 59 in cylinder 42.

Downward movement of plunger rod 38 is not resisted by fluid within cylinder 42 because the ball check valve is opened in response to such downward movement. This downward plunger movement increases fluid pressure in lower compartment 61 which in turn unseats sphere 72 from aperture 68 whereby fluid may flow from the lower compartment 61 through aperture 68 into cavity 70 then through apertures 74 and into upper compartment 59.

Upward movement of plunger rod 38 is resisted by fluid within cylinder 42 because the ball check valve is closed in response thereto. Upward plunger movement increases fluid pressure in upper compartment 59 which in turn seats sphere 72 against aperture 68, thus preventing fluid flow from upper compartment 59 through aperture 68 to lower compartment 61. Swab cups 58 and 60 likewise prevent fluid flow between compartments 59 and 61. Thus, fluid in upper compartment 59 is discharged out port 48, down bypass line 46 and through port 50 into lower compartment 61. The control valve 52 setting determines how fast the fluid may escape and flow through bypass line 46, up to the maximum rate set by choke 54, which in turn determines the velocity of upward withdrawal of plunger 38.

During upward plunger movement, the space vacated below swab 56 in lower compartment 61 is greater than the newly occupied space in upper compartment 59 because of the displacement of plunger rod 38, and hence fluid exiting through port 48 and flowing through bypass line 46 and into lower compartment 61 through port 50 is not sufficient to occupy the vacated space. Additional fluid is supplied by a 46 foot long 2⅜ inch fluid reservoir pipe 76 vertically mounted to the derrick and connected to the hydraulic cylinder by a ½ inch steel pipe 78 at its bottom. The reservoir pipe 76 is capped at 80 and air pressure is applied at 22 pounds per square inch when plunger rod 38 is in the full down position. Approximately 2 gallons of additional fluid is withdrawn from the oil reservoir pipe 76 in a complete 26 foot travel stroke of swab 56.

In operation, the climber snaps cable end 26 onto his safety belt 20 and begins ascent up the ladder. The distance between pulleys 28 and 30 when the climber is on the ground is approximately 29 feet, with lower pulley 30 and plunger 38 at or near their uppermost extensions. Since the upper pulley 28 is at the top of the derrick as the climber progresses up the ladder he feeds slack to the top pulley. The slack is fed through the top pulley and progresses through the four line cable 24 so that pulley 30 moves downwardly and the distance between the pulleys increases about 1 foot for each four feet the climber moves up the ladder. Polished rod plunger 38 has a 26 foot stroke in cylinder 42 and thus the climber may move 104 feet before reaching the limit of the plunger stroke. As previously indicated, there is no resistance inside the hydraulic cylinder to downward movement of plunger rod 38. This plunger rod and lower pulley 30 provide a constant tension of about 37 pounds in the cable during ascent of the climber.

If the climber stops along the ascension path from the bottom to the top of the ladder, or if he starts down voluntarily or if he slips and loses hold or falls, descension is controlled at a safe rate. When ascent stops, sphere 72 immediately drops to seat against aperture 68, whereby this one-way valve shuts off and prevents fluid flow through swab 56 from upper compartment 59 to lower compartment 61 within cylinder 42. As the climber starts to descend, plunger 38 is withdrawn upwardly out of cylinder 42. Swab cups 58 and 60 prevent fluid movement downward from upper compartment 59 to lower compartment 61 and hence the fluid in the upper compartment is trapped between swab 56 and the packing of stuffing box 44 at the top of the cylinder. Fluid in the upper compartment is discharged out port 48, down bypass line 46 and through port 50 into lower compartment 61. The control valve 52 setting determines how fast the fluid may escape, up to the maximum rate set by choke 54, through bypass line 46 as the plunger moves upward.

The velocity of upward withdrawal of plunger 38, and hence the descension rate of the climber, is thus controlled by valve 52. If hydraulic oil is used as the fluid in the cylinder and if valve 52 is closed, no withdrawal may be accomplished provided there is no air in the cylinder. If valve 52 is cracked a slight amount, a slow withdrawal may be accomplished. If valve 52 is full open, maximum withdrawal rate may be accomplished. The maximum rate would be determined by how much force was being applied to the plunger 38, which would be approximately 4 times the weight of the climber, and hence the major factors would be the weight of the climber, the viscosity of the oil (largely a factor of the temperature of the system), and the friction in the system. The preferred maximum descension rate is about 2 feet per second. The added inclusion of choke 54 is preferred as a backup safety feature in case valve 52 is opened beyond what would yield a satisfactory descension rate. In most applications, valve 52 is left full open unless it is desired to stop descent of the climber.

The dimensions, rates, materials, and other quantitative data indicated herein are of course exemplary for purposes of providing a better understanding, and are not a constraint of the invention.

The present safety device is well suited for use with portable derricks that telescope down such as are found on oil well service rigs. With the derrick extended to the maximun height and safety belt 20 attached to the lowest rung of ladder 18, plunger rod 38 is almost completely upwardly extended to its outermost position above cylinder 42. While telescoping the derrick down, the plunger rod drops down inside the cylinder leaving a slight tension in cable 24. If the downward plunger stroke is completed before upper derrick section 14 is completely telescoped down into lower derrick section 12, cable 24 goes slack and the slack will pile up on the ground near ladder 18 and can be gathered up and stored after the derrick is completely retracted. The safety device does not interfere with the telescoping process of the derrick, nor are there any special assembly or mounting requirements for the safety device before and after telescoping of the derrick. Furthermore, the safety device need not be detached from the derrick prior to telescoping, nor mounted thereto only after telescoping, and hence a significant reduction in set-up cost is realized.

Figure 3:
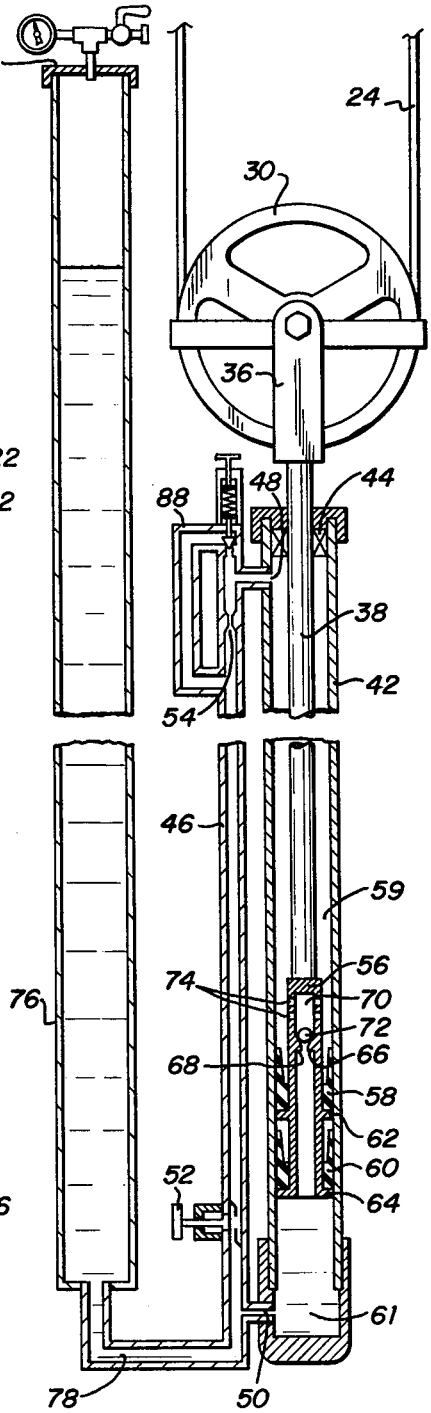
FIG. 3 is an enlarged partially sectioned view of a portion of FIG. 1 to better show the details thereof.

There is further shown in FIG. 3 a bypass control valve regulator 88 installed in parallel with choke 54 and preset to 400 PSI to allow withdrawal of plunger 38 at a faster rate than choke 54 would allow. This allows a portable derrick to telescope separationally upward at its normal rate using the rig hydraulic system without overstressing the safety device. This also pre-tests the cable to 400 lbs. strength if the cable end 26 is anchored relative to the lower derrick section, e.g., attached to the bottom rung of the ladder, while the upper derrick section moves upward. This provides an automatic safety check of cable strength upon derrick set-up, thus further protecting the workman against a faulty or worn cable.

Derricks typically have guy wires such as 86, FIG. 1. In the event of an emergency, such as a fire at the wellhead, wherein descent down the ladder is blocked, the climber may snap his safety belt 20 to the guy wire without detaching cable end 26, and hence descend along the guy wire at a safe controlled descension rate to a different portion of the rig, for example the engine portion. In case more distance is needed or a different guy wire is desired, the device is easily modified to permit the longer travel needed to escape the derrick safely along the guy wire. For example, pulleys with extra sheaves may be used to provide a longer cable, or a longer cylinder may be used. The particularly disclosed device allows 100 feet of travel along a vertical ladder by the climber. These minor changes easily enable a 150 foot or 200 foot travel along a guy wire depending upon the hypotenuse angle formed by the guy wire. One particular device employs five sheaves and allows 130 feet of travel, and uses ¼" diameter cable.

The present invention thus provides a safety device which automatically adjusts to the height reached by the climber along his ascension path and provides a controlled descension rate automatically from anywhere therealong.

It is recognized that various modifications are possible within the scope of the appended claims.

I claim:

1. A fall prevention safety device for attachment to a harness worn by a workman for providing a safely controlled descension rate from an elevated structure comprising:

retraction means anchored relative to said elevated structure and having a reciprocal actuator having one preferred direction of motion, and means resisting the other direction of motion of said actuator;

interconnection means connecting said harness to said actuator such that during ascent of said workman along a predetermined ascension path up said elevated structure said actuator moves in said one preferred direction for continuously adjusting to the increasing height attained by said workman during said ascent and for compensatingly maintaining a taut non-slack condition of said interconnection means, descent from any and all points along said path being immediately and automatically dynamically limited to a descension rate controlled by said means resisting motion of said actuator in said other direction.

2. The invention according to claim 1 further comprising adjustable control means for varying said descension rate.

3. A fall prevention safety device for attachment to a harness worn by a workman for providing a safely controlled descension rate from an elevated structure, comprising:

fluid cylinder means anchored relative to said elevated structure and having plunger means reciprocally movable therein, said plunger means being substantially unresisted against movement in one direction by fluid within said cylinder, said plunger means being substantially resisted against movement in the other direction by said fluid;

interconnection means connecting said harness to said plunger means such that during ascent of said workman along a predetermined ascension path up said elevated structure said plunger means is free to move in said one direction and such that upon termination of said ascent anywhere along said predetermined ascension path said fluid cylinder means automatically limits descension of said workman at a controlled safe rate as said plunger means moves in said other direction.

4. The invention according to claim 3 wherein said plunger continuously adjusts to the increasing height attained by said workman during said ascent along said predetermined ascension path by continuously moving in said one direction and compensatingly maintaining a taut non-slack condition of said interconnection means such that descension of said workman from any point along said predetermined path is immediately limited to said controlled safe rate by said plunger movement in said other direction transmitted through said interconnection means.

5. The invention according to claim 4 wherein said plunger means immediately and automatically without manual intervention reverses its movement from said one direction to said other direction in response to descension of said workman from any point along said predetermined path.

6. A fall prevention safety device for attachment to a harness worn by a workman for providing a safely controlled descension rate from an elevated structure, comprising:

fluid cylinder means anchored relative to said elevated structure and including plunger means reciprocally movable therein and one-way valve means actuatable to an open position by movement of said plunger means in one direction and actuatable to a closed position by movement of said plunger means in the other direction, said open position of said one-way valve means providing minimal fluid resistance to movement of said plunger means, said closed position of said one-way valve means providing substantial fluid resistance to movement of said plunger means;

interconnection means connecting said harness to said plunger means such that ascension of said workman along a predetermined path up to said elevated structure enables movement of said plunger in said one direction whereby to open said one-way valve means and afford free ascension of said workman along said predetermined path, and such that descension of said workman moves said plunger means in said other direction whereby to close said one-way valve means and afford slow descension of said workman controlled by said resisted movement of said plunger in said other direction.

7. The invention according to claim 6 wherein said interconnection means comprises a pulley and cable system having one cable end connected to said harness, and operatively coupled to said plunger means to immediately actuate said one-way valve means to said closed position upon termination of ascent of said workman at any and all points along said predetermined path.

8. The invention according to claim 7 wherein said plunger means is vertically reciprocal downward in said one direction and upward in said other direction, and said pulley and cable system comprises a lower pulley connected by a yoke to the upper end of said plunger and an upper pulley connected by a yoke to said elevated structure at a position spaced above said lower pulley, and a cable having one end connected to said harness and then strung at least once around said upper then lower pulleys and then connected at its other end to said upper pulley yoke, such that during ascent of said workman the separation of said pulleys increases and said plunger falls substantially freely in said fluid cylinder means, and during descent of said workman the separation of said pulleys decreases as said lower pulley is pulled upwardly by said cable, which upward movement is substantially retarded by said fluid resistance to upward plunger movement, said substantially free downward movement of said plunger enabling said lower pulley to take up any slack in said cable during said ascent of said workman to provide a continuously taut condition of said cable and provide immediate retardation upon descent.

9. The invention according to claim 6 wherein said fluid cylinder means comprises:

an elongated cylinder mounted to said structure and having a closed end, and having an open end sealed around said plunger and through which said plunger reciprocates;

sealing means carried by said plunger adjacent the end thereof interior of said cylinder and defining first and second separate sealed compartments on either side of said sealing means within said cylinder adjacent said open and closed ends thereof, respectively, which compartments change in volume as said plunger reciprocates;

a bypass line communicating with said cylinder at first and second ports communicating respectively with said first and second compartments enabling fluid flow therebetween through said bypass line;

reservoir means holding fluid and communication with said bypass line to supply extra fluid to one of said compartments having space vacated by said plunger upon movement thereof.

10. The invention according to claim 9 wherein said interior end of said plunger carries said one-way valve and wherein said movement of said plunger in said one direction inserts said plunger further into said cylinder such that fluid pressure in said second compartment opens said one-way valve to permit fluid flow therethrough from said second to said first compartment, and movement of said plunger in said other direction withdraws said plunger from said cylinder such that fluid pressure in said first compartment closes said one-way valve to prevent fluid flow therethrough from said first to said second compartment whereby to force fluid through said bypass line to said second compartment.

11. The invention according to claim 10 wherein said bypass line includes restriction means providing resistance to fluid flow whereby to afford said resisted movement of said plunger in said other direction and hence said slow controlled descension of said workman.

12. The invention according to claim 11 wherein said restriction means comprises an adjustable control valve adjustably restricting said bypass line.

13. The invention according to claim 12 wherein said restriction means further comprises a choke in said bypass line setting a maximum permissible fluid flow rate therethrough.

14. The invention according to claim 11 further comprising normally closed bypass line regulator means in parallel with said restriction means and presettable to a predetermined pressure to open thereat to permit faster movement of said plunger in said other direction upon application of a force thereto causing said perdetermined pressure, whereby to prevent overstressing of said safety device and also to afford automatic pre-testing thereof up to said last mentioned force.

15. The invention according to claim 10 wherein said plunger interior end has a tubing swab mounted thereto comprising a hollow tubular member extending rearwardly toward said closed cylinder end and of smaller diameter than said cylinder, said tubing swab having one or more annular sealing swab cups disposed therearound and forming said sealing means, the interior wall of said tubing swab having an inwardly laterally radially extending flange forming a central aperture forwardly of said one or more swab cups and communicating with said second compartment, said inward flange defining a cavity forwardly thereof within the interior of said tubing swab, the cylindrical wall of said tubing swab having one or more apertures formed therethrough forwardly of said inward flange and communicating between said cavity and said first compartment, said one-way valve comprising a ball having a diameter larger than the diameter of said central aperture and trapped in said cavity, said ball being seated against the forward lip of said central aperture in said closed position of said one-way valve to prevent fluid flow through said central aperture, said ball being unseated from said forward lip of said central aperture in said open position of said one-way valve to permit fluid flow from said second compartment through said central aperture through said cavity and through said one or more wall apertures into said first compartment.

16. A fall prevention safety device for attachment to a harness worn by a workman for providing a safely controlled descension rate from an elevated structure, comprising:

an elongated cylinder vertically mounted to said structure and having a closed bottom end;

an elongated plunger extending through the top end of said cylinder and vertically reciprocal therein, said top end of said cylinder being sealed around said plunger;

fluid contained in said cylinder;

sealing means carried by said plunger adjacent the end thereof interior of said cylinder and defining upper and lower separate sealed compartments on either side of said sealing means within said cylinder adjacent said top and bottom ends thereof, respectively, which compartments change in volume as said plunger reciprocates;

one-way valve means actuated to an open condition by fluid pressure in said bottom compartment in response to downward movement of said plunger to permit substantially unimpeded downward movement of said plunger, and actuated to a closed position by fluid pressure in said upper compartment in response to upward movement of said plunger to substantially resist upward plunger movement;

a pulley and cable system comprising a lower pulley connected by a yoke to the upper end of said plunger and an upper pulley connected by a yoke to said elevated structure at a position spaced above said lower pulley, and a cable having one end connected to said harness and then strung at least once around said upper and lower pulleys and then connected at its other end to said upper pulley yoke, such that during ascent of said workman the separation of said pulleys increases and said plunger falls substantially freely in said cylinder, and during descent of said workman the separation of said pulleys decreases as said lower pulley is pulled upwardly by said cable which upward movement is substantially retarded by fluid resistance to upward plunger movement, said substantially free downward movement of said plunger enabling said lower pulley to take up slack in said cable during said ascent of said workman to provide a continuously taut condition of said cable and provide immediately retardation upon descent.

17. The invention according to claim 16 wherein said fluid comprises hydraulic oil, and further comprising:

a bypass line communicating with said cyclinder at upper and lower ports communicating respectively with said upper and lower compartments enabling fluid flow therebetween through said bypass line;

reservoir means holding fluid and communicating with said bypass line to supply extra fluid to said lower compartment having space vacated by said plunger upon upward movement thereof.

18. The invention according to claim 17 further comprising an adjustable control valve adjustably restricting said bypass line to control the rate of fluid flow therethrough and hence said descension rate.

19. The invention according to claim 17 wherein said plunger interior end has a tubing swab mounted thereto comprising a hollow tubular member extending downwardly toward said bottom cylinder end and of a smaller diameter than said cylinder, said tubing swab having one or more annular sealing swab cups disposed therearound and forming said sealing means, the interior walls of said tubing swab having an inwardly laterally radially extending flange forming a central aperture upwardly of said one or more swab cups and communicating with said lower compartment, said inward flange defining a cavity upwardly thereof within the interior of said tubing swab, the cylindrical wall of said tubing swab having one or more apertures formed therethrough upwardly of said inward flange and communicating between said cavity and said upper compartment, said one-way valve comprising a ball having a diameter larger than the diameter of said central aperture and trapped in said cavity, said ball being seated against the upper lip of said central aperture in said closed position of said one-way valve to prevent fluid flow through said central aperture and force fluid flow through said upper port then down through said bypass line and through said lower port into said lower compartment and thus afford fluid resistance to upward plunger movement and hence said retarded descension rate, said ball being unseated from said upper lip of said central aperture in said open position of said one-way valve to permit fluid flow from said secondary compartment through said central aperture through said cavity and through said one or more wall apertures into said first compartment to provide substantially unimpeded downward movement of said plunger.

20. The invention according to claim 16 wherein said elevated structure comprises a lower section telescopically receiving an upper section in retracted condition, said cylinder being mounted to said lower section, and said upper pulley being mounted to said upper section, and comprising a bypass line communicating with said cylinder at upper and lower ports communicating respectively with said upper and lower compartments enabling fluid flow therebetween through said bypass line, restriction means in said bypass line limiting the rate of fluid flow therethrough to provide said retarded descension of said workman and afford a safe, slow rate thereof, and further comprising normally closed bypass line regulator means in parallel with said restriction means and presettable to open at a predetermined pressure to permit faster upward withdrawal of said plunger upon application of a force thereto causing said predetermined pressure, such that during separational telescoping of said structure sections, and with said one cable end anchored relative to said lower section, said telescoping is accomplished at a faster rate than said workman descension rate, overstressing of said safety device is prevented, and said cable is automatically pre-tested up to a strength of said last mentioned force.

* * * * *